US006611668B2

(12) United States Patent
Watanabe et al.

(10) Patent No.: US 6,611,668 B2
(45) Date of Patent: Aug. 26, 2003

(54) IMAGE FORMING APPARATUS WITH RESIDUAL DEVELOPING CHARGING FEATURE

(75) Inventors: Yasunari Watanabe, Shizuoka (JP); Motoki Adachi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,275

(22) Filed: Aug. 30, 2002

(65) Prior Publication Data

US 2003/0059231 A1 Mar. 27, 2003

(51) Int. Cl.[7] ..... G03G 15/00; G03G 21/00

(52) U.S. Cl. ..... 399/129; 399/150; 399/174; 399/343

(58) Field of Search ..... 399/129, 149, 399/128, 50, 150, 174, 175, 176, 343

(56) References Cited

U.S. PATENT DOCUMENTS 4,761,672 A * 8/1988 Parker et al. ..... 399/232
5,066,982 A * 11/1991 Hosoya et al. ..... 399/150
6,421,512 B2 * 7/2002 Watanabe et al. ..... 399/149

FOREIGN PATENT DOCUMENTS

JP 08234545 A * 9/1996 ..... G03G/15/02
JP 2001-215798 * 8/2001

OTHER PUBLICATIONS

U.S. patent application Ser. No. 09/957,249, filed Feb. 21, 2001, pending.
U.S. patent application Ser. No. 10/233,507, filed Sep. 4, 2002, pending.

* cited by examiner

*Primary Examiner*—Sophia S. Chen
*Assistant Examiner*—Ryan Gleitz
(74) *Attorney, Agent, or Firm*—Fitzpatrick, Cella, Harper & Scinto

(57) ABSTRACT

In order not to expel toner excessively when bias is applied, a cleanerless image forming apparatus includes a first developer charge amount controlling device 7, provided on a downstream side of a transfer device 5 in a moving direction of an image bearing member 1, e.g. a photosensitive drum, for applying a DC bias for making uniform a charge amount of residual developer remaining on the image bearing member 1, and/or a second developer charge amount controlling device 8, provided on a downstream side of the first developer charge amount controlling device 7 in a rotating direction of the image bearing member 1, for applying a DC bias for charging the residual developer in a normal polarity. An absolute value of a slope of the DC voltage applied to the first developer charge amount controlling device 7 and/or an absolute value of a slope of the DC voltage applied to the second developer charge amount controlling device 8 are equal to 2000 V/sec or smaller.

21 Claims, 5 Drawing Sheets

| | TIME PERIOD UNTIL BIAS IS IN STEADY STATE | SLOPE OF APPLIED VOLTAGE | DISCHARGED TONER FROM TONER CHARGEAMOUNT CONTROLLING DEVICE |
|---|---|---|---|
|  | 0.05 SEC | 8000 V/SEC | YES |
|  | 0.10 SEC | 4000 V/SEC | YES |
|  | 0.15 SEC | 2667 V/SEC | YES (AMOUNT IS SMALL) |
|  | 0.20 SEC | 2000 V/SEC | NO |
|  | 0.25 SEC | 1600 V/SEC | NO |

| | TIME PERIOD UNTIL BIAS IS IN STEADY STATE | SLOPE OF APPLIED VOLTAGE | DISCHARGED TONER FROM TONER CHARGEAMOUNT CONTROLLING DEVICE |
|---|---|---|---|
|   | 0.10 SEC | 8000 V/SEC | YES |
|   | 0.20 SEC | 4000 V/SEC | YES |
|   | 0.30 SEC | 2667 V/SEC | YES |
|   | 0.40 SEC | 2000 V/SEC | NO |
|   | 0.50 SEC | 1600 V/SEC | NO |

IMAGE FORMING APPARATUS WITH RESIDUAL DEVELOPING CHARGING FEATURE

BACKGROUND OF THE INVENTION

1. Field of the Invention

The present invention relates to an image forming apparatus having a charging device for charging developer remaining on an image bearing member such as a photosensitive member or a dielectric. Preferably, the present invention relates to an image forming apparatus having no dedicated cleaner. More specifically, the present invention is preferably applied to an image forming apparatus where, after developer (toner) is transferred onto a transfer material, a developing device cleans developer (toner) remaining on an image bearing member, and simultaneously, development is performed.

2. Description of the Related Art

Up to now, image forming apparatus using transfer type electrophotography such as copying machines, printers, and facsimile machines are known. An image forming apparatus is formed of a photosensitive member as an image bearing member which is generally a rotating drum, a charging device for uniformly charging the photosensitive member in a predetermined polarity and at a predetermined potential (charging process), an electrostatic latent image forming device, that is, an exposure device for forming an electrostatic latent image on the charged photosensitive member (exposing process), a developing device for visualizing by developer (toner) the electrostatic latent image formed on the photosensitive member (developing process), a transfer device for transferring the toner image from the photosensitive member onto a transfer material such as paper (transferring process), a cleaning device for removing toner remaining on the photosensitive member after the transferring process to clean the surface of the photosensitive member (cleaning process), a fixing device for fixing the toner image on the transfer material (fixing process), and the like. The photosensitive member is repeatedly used in image formation in the electrophotographic process (the charging process, the exposing process, the developing process, the transferring process, and the cleaning process).

Toner remaining on the photosensitive member after the toner image is transferred onto the transfer material is removed from the surface of the photosensitive member by the cleaning device. The removed toner is collected by and in the cleaning device. The collected toner accumulates in the cleaning device as waste toner. However, from the viewpoint of environment conservation, effective use of resources, and the like, it is preferable that no waste toner is generated.

Accordingly, image forming apparatus which return waste toner accumulated in the cleaning device to the developing device to reuse the toner in the developing device are known.

Cleaner-less image forming apparatus, which eliminate the cleaning device, are also known. A cleaner-less image forming apparatus removes toner remaining on a photosensitive member by the developing device after the transferring process, and the removed toner is collected in the developing device to be reused in the developing device. In such a cleaner-less image forming apparatus, the developing device cleans up the toner remaining on the photosensitive member simultaneously with development of an electrostatic latent image (cleaning simultaneous with developing).

"Cleaning simultaneous with developing" is a method in which residual toner, that is, toner which is not transferred by the transfer device and is remaining on the photosensitive member is collected in the developing device in following developing processes. More specifically, the photosensitive member having residual toner thereon is then charged by a charging device, an electrostatic latent image is formed on the surface of the photosensitive member by an exposure device, and the electrostatic latent image is developed by the developing device. Simultaneously with the development of the electrostatic latent image by the developing device, toner remaining on the photosensitive member without being developed is collected in the developing device by bias for removing fog (potential difference $V_{back}$ for removing fog as the potential difference between direct current voltage applied to the developing device and the surface potential of the photosensitive member).

In this method, the residual toner is collected in the developing device to be used in following developing processes. Therefore, no waste toner is generated, and troublesome maintenance for collecting waste toner is eased. Further, since the cleaning device is unnecessary, this method is also effective in miniaturizing the image forming apparatus.

However, if the charging device is a contact charging device which is in contact with the surface of the photosensitive member and charges the photosensitive member, when residual toner on the photosensitive member passes through a contact portion (charging portion) between the photosensitive member and the contact charging device, part of the residual toner which is charged oppositely to the normal polarity of toner (reversal toner) attaches to the contact charging device. Therefore, the contact charging device is contaminated by toner to an unacceptable level, and thus, the charging device can not sufficiently charge the photosensitive member.

Further, such reversal toner can not be appropriately collected in the developing device.

Therefore, the present inventors proposed an image forming apparatus of the cleaner-less type which, when the charging device is a contact charging device, is free from poor charging and a poor image by preventing residual toner from attaching to the charging device and by efficient collection by the developing device of the residual toner, and offers benefits of a cleaner-less image forming apparatus (JP 2001-215798 A).

The above-mentioned image forming apparatus includes a first developer charge amount controlling device (first developer charging member) for charging residual developer on a photosensitive member and located on a downstream of a transfer device in a photosensitive member rotational direction, and a second developer charge amount controlling device (second developer charging member) for charging residual developer on the photosensitive member and located on a downstream of the first developer charge amount controlling device and on an upstream of a charging device. The first developer charge amount controlling device charges residual developer, that is, developer which is not transferred by the transfer device and is remaining on the photosensitive member, in an opposite polarity to the normal polarity of the developer. Then, the second developer charge amount controlling device charges in the normal polarity the residual developer which was charged in the opposite polarity to the normal polarity. After that, the charging device charges the photosensitive member, and simultaneously, appropriately charges the residual developer.

Since the residual developer is prevented from attaching to the charging device and the developing device efficiently collects the residual developer, an image forming apparatus which is free from poor charging and a poor image and which offers benefits of a cleaner-less image forming apparatus can be provided.

However, when a developer charge amount controlling device is in contact with a photosensitive member, developer may remain more or less at the contact portion between the developer charge amount controlling device and the photosensitive member. At the instant when bias is applied to the developer charge amount controlling device, and at the instant when the bias application is broken, the residual developer no longer stays at the contact portion between the photosensitive member and the developer charge amount controlling device, and is transferred onto the photosensitive member, to thereby result in a poor image.

SUMMARY OF THE INVENTION

An object of the present invention is to provide an image forming apparatus which retains developer to be excessively expelled from a developer charging member onto an image bearing member.

Another object of the present invention is to provide an image forming apparatus which can make appropriate the charge amount of residual developer on an image bearing member.

A further object of the present invention is to provide an image forming apparatus capable of preventing a poor image due to residual developer on a developer charging member and maintaining high image quality for a long time.

Yet another object of the present invention is to provide an image forming apparatus which prevents residual developer on an image bearing member from attaching to a charging member.

A still further object of the present invention is to provide an image forming apparatus suitable for a cleaner-less system without a dedicated cleaner.

An additional object of the present invention is to provide an image forming apparatus, which improves the efficiency of collection of residual developer on an image bearing member to a developing device.

Further objects and features of the present invention will become clearer upon review of the following detailed description with reference to the attached drawings.

DETAILED DESCRIPTION OF THE PREFERRED EMBODIMENTS

A preferable embodiment of the present invention is now described in detail by way of example with reference to the attached drawings. It is to be noted that the size, material, shape, relative arrangement, and the like of components described herein are not intended to limit thereto the scope of the present invention unless otherwise stated.

Figure 1:
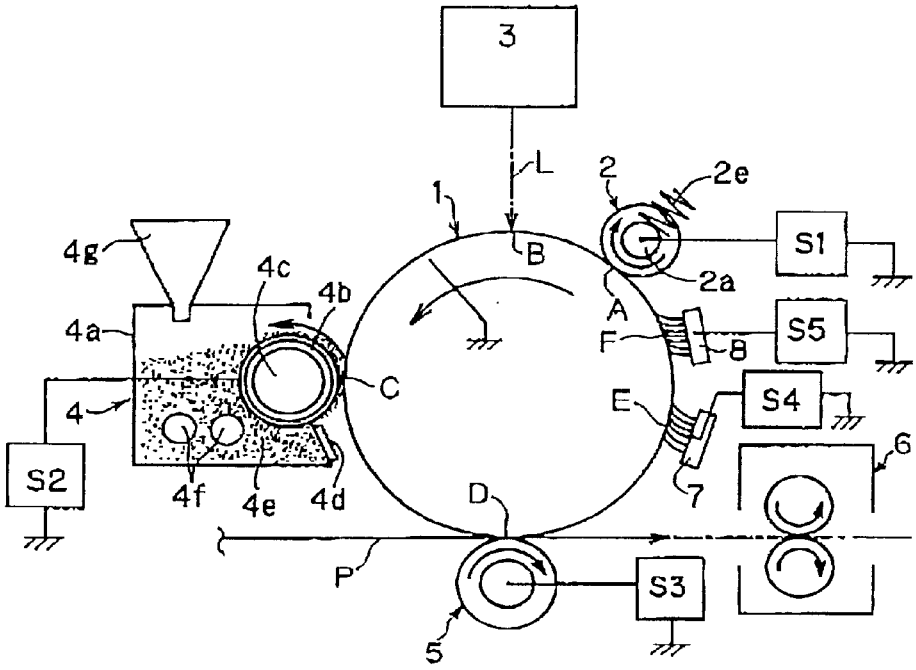
FIG. 1 is a schematic view illustrating a structure of an image forming apparatus according to an embodiment of the present invention.
Figure 2:
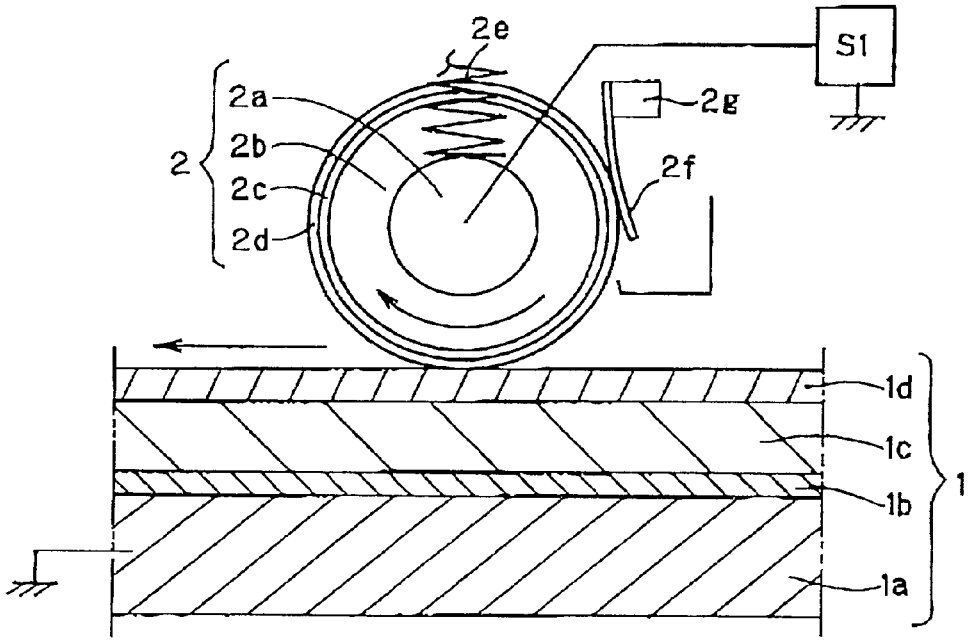
FIG. 2 is a schematic view illustrating a layer structure of a photosensitive drum and a charging roller.

FIG. 1 is a schematic sectional view of an image forming apparatus according to the present invention. FIG. 2 is a sectional view illustrating a layer structure of an image bearing member and a charging device according to the present invention. A schematic structure of an entire printer is described hereinbelow with reference to FIG. 1.

(a) Image Bearing Member

In FIG. 1, an image bearing member 1 is an electrophotographic photosensitive member in the shape of a rotating drum (hereinafter referred to as a photosensitive drum). The photosensitive drum 1 is an organic photo conductor (OPC) which can be negatively charged having the outside diameter of 50 mm. The photosensitive drum 1 is rotated counterclockwise as shown by an arrow about a supporting shaft at the process speed (circumferential speed) of 100 mm/sec.

As illustrated in FIG. 2, the photosensitive drum 1 is formed by applying on the surface of a cylinder made of aluminum (conductive drum base) 1*a* an underlayer 1*b* for suppressing interference of light and improving adhesion of an upper layer, a charge generation layer 1*c*, and a charge transport layer 1*d* in this order.

(b) Charging Device

A contact charging device 2 uniformly charges a peripheral surface of the photosensitive drum 1. In this embodiment, a charging roller which can be brought into contact with the photosensitive drum 1 is used.

The charging roller 2 is rotatably held by bearings (not shown) supporting both end portions of a core 2*a*. A compression spring 2*e* biases the charging roller 2 toward the photosensitive drum 1, and presses the charging roller 2 against the surface of the photosensitive drum 1 with predetermined pressing force. The charging roller 2 is driven by the rotation of the photosensitive drum 1 and is rotated. The portion where the photosensitive drum 1 and the charging roller 2 are press-contacting each other is a charging portion (charging nip portion) A (See FIG. 1).

A power supply S1 applies predetermined charging bias voltage to the core 2*a* of the charging roller 2. The charging bias voltage charges the peripheral surface of the photosensitive drum 1 in a predetermined polarity and at a predetermined potential.

In this embodiment, the charging bias voltage applied to the charging roller 2 is oscillating voltage formed by superimposing direct voltage (Vdc) on alternating voltage (Vac).

More specifically, the charging bias voltage is oscillating voltage formed by superimposing direct voltage of −500 V on alternating voltage having the frequency f of 1000Hz, the peak-to-peak voltage Vpp of 1400 V, and a sinusoidal voltage waveform. The peripheral surface of the photosensitive drum 1 is uniformly charged at −500 V (dark portion potential Vd).

The charging roller 2 has the longitudinal length of 320 mm. As illustrated in the sectional view illustrating the layer structure of FIG. 2, the charging roller 2 has a three-layer structure and is formed by laminating on the peripheral surface of the core (supporting member) 2*a* an underlayer 2*b*, an intermediate layer 2*c*, and a surface layer 2*d* in this order. The underlayer 2*b* is a foam sponge layer for reducing noise generated in charging. The intermediate layer 2*c* is a conductive layer for obtaining uniform resistance of the entire charging roller 2, and the surface layer 2*d* is a protective layer provided for preventing a leak even when the photosensitive drum 1 has a defects thereon such as a pin hole.

More specifically, specifications of the charging roller 2 according to this embodiment are as follows:

Core 2*a*: round bar made of stainless steel having the diameter of 6 mm

Underlayer 2*b*: foamed EPDM with carbon dispersed therein having the specific gravity of 0.5 g/cm$^3$, the volume resistivity of $10^2$–$10^9$Ω·cm, the layer thickness of 3.0 mm, and the length of 320 mm Intermediate layer 2*c*: NBR rubber with carbon dispersed therein having the volume resistivity of $10^2$–$10^6$Ω·cm and the layer thickness of 700 μm Surface layer 2*d*: TORESIN of a fluorine compound with tin oxide and carbon dispersed therein having the volume resistivity of $10^7$–$10^{10}$Ω·cm ,the surface roughness (average surface roughness Ra at ten different points according to the JIS standard) of 1.5 μm, and the layer thickness of 10 μm In this embodiment, as illustrated in FIG. 2, a cleaning film (charging roller cleaning member) 2*f* is flexible. One end of the cleaning film 2*f* is fixed by a support member 2*g* which is arranged in parallel with the longitudinal direction of the charging roller 2 and reciprocates to the longitudinal direction by a fixed amount such that the cleaning film 2*f* forms a contact nip with the charging roller 2 on the plane in the vicinity of a free end.

The support member 2*g* reciprocates to the longitudinal direction by the fixed amount by being driven by a drive motor of the printer through a gear train. The cleaning film 2*f* slides on the surface layer 2*d* of the changing roller 2. As a result, contaminants attached to the surface layer 2*d* (finely powdered toner, external additives, and the like) are removed. Preferably, the cleaning film 2*f* is made of a resin and triboelectrically charges the toner attached to the surface of the charging roller 2 in the normal polarity. Further, as illustrated in FIG. 2, the cleaning film 2*f* is preferably arranged such that there is a clearance between its free end and the surface of the charging roller 2. Toner on the charging roller 2 is dispersed by the cleaning film 2*f*. Toner attached to the charging roller 2 is charged in the normal charge polarity while being dispersed by the cleaning film 2*f*. Toner charged in the normal charge polarity is returned from the charging roller 2 to the photosensitive drum 1 due to potential difference between the voltage applied to the charging roller 2 and the potential of the photosensitive drum 1.

(c) Electrostatic Latent Image Forming Device

A laser beam scanner (an electrostatic latent image forming device) 3 is an exposure device for forming an electrostatic latent image on the surface of the charged photosensitive drum 1 using a semiconductor laser. The laser beam scanner 3 outputs laser beams which are modulated correspondingly to image signals sent from a host device such as an image reading apparatus (not shown) to the printer side to perform laser scanning and exposure L (image exposure) regarding the uniformly charged surface of the photosensitive drum 1 at an exposure position B. By lowering the potential of a place on the surface of the photosensitive drum 1 which is irradiated by laser beams through the laser scanning and exposure L, an electrostatic latent image which corresponds to image information which was scanned and exposed is gradually formed on the surface of the photosensitive drum 1.

(d) Developing Device

A developing device 4 supplies developer (toner) to the electrostatic latent image formed on the surface of the photosensitive drum 1 and visualizes the electrostatic latent image. In this embodiment, the developing device 4 is a reverse developing device using a two-component magnetic brush developing system.

A non-magnetic developing sleeve 4*b* is rotatably arranged inside a developing container 4*a* with part of its peripheral surface exposed to the external. A magnet roller 4*c* is inserted in the developing sleeve 4*b* and fixed so as not to be rotated. A developer coating blade 4*d* limits the amount of developer. A two-component developer 4*e* is contained in the developing container 4*a*. A developer agitating member 4*f* is disposed on the bottom side in the developing container 4*a*. A toner hopper 4*g* contains toner to be supplied.

The two-component developer 4*e* contained in the developing container 4*a* includes toner and magnetic carrier, and is agitated by the developer agitating member 4*f*. In this embodiment, the magnetic carrier has the volume resistivity of about $10^{13}$Ω·cm and the particle size of about 40 μm. The toner is triboelectrically charged in the negative polarity by friction with the magnetic carrier. More specifically, the normal polarity of the charged toner is the same as the charging polarity of the charging roller 2.

The developing sleeve 4*b* maintains the closest distance (hereinafter referred to as S-Dgap) of 350 μm between itself and the photosensitive drum 1, and is arranged so as to be opposed to and proximate to the photosensitive drum 1. The portion where the photosensitive drum 1 and the developing sleeve 4*a* are opposed to each other is a developing portion C. The developing sleeve 4*b* is driven by the developing portion C to rotate in a direction opposite to the direction of rotation of the photosensitive drum 1.

Part of the two-component developer 4*e* is held as a magnetic brush layer on the peripheral surface of the developing sleeve 4*b* by magnetic force of the magnet roller 4*c* in the developing sleeve 4*b*. The magnetic brush layer is fed as the developing sleeve 4*e* rotates, and is limited to have a predetermined thickness by the developer coating blade 4*d*. The limited magnetic brush layer comes in contact with the surface of the photosensitive drum 1 at the developing portion C to appropriately slide on the surface of the photosensitive drum 1. A power supply S2 applies predetermined developing bias to the developing sleeve 4*b*.

In this embodiment, the developing bias applied to the developing sleeve 4*b* is oscillating voltage formed by superimposing alternating voltage (Vac) on direct voltage (Vdc). More specifically, the developing bias is oscillating voltage formed by superimposing alternating voltage of 1600 V on direct voltage of −350 V. The two-component developer 4*e* is coated as a thin layer on the surface of the developing sleeve 4*b* which is rotating, and is fed to the developing portion C. At the developing portion C, an electric field generated by the developing bias causes toner contained in the two-component developer 4*e* to selectively attach to the surface of the photosensitive drum 1 so as to correspond to the electrostatic latent image formed on the surface of the photosensitive drum 1, and the electrostatic latent image is developed as a toner image. In this embodiment, the electrostatic latent image is developed as the toner image using a so-called reversal developing system, that is, a system where an image portion of the surface of the photosensitive drum 1 is exposed by the exposure device and toner attaches to a portion where the charge is removed.

As the developing sleeve 4*b* is rotated, the two-component developer 4*e* on the developing sleeve 4*b* which passed through the developing portion C is returned to a developer reservoir portion in the developing container 4*a*.

In order to maintain in a predetermined fixed range the toner density of the two-component developer 4*e* in the developing container 4*a*, the toner density is detected by, for example, an optical toner density sensor (not shown). The toner hopper 4*g* is controlled and driven according to information thus detected. Toner contained in the toner hopper 4*g* is supplied to the two-component developer 4*e* in the developing container 4*a*. The agitating member 4*f* agitates the supplied toner.

(e) Transfer Device/Fixing Device

In this embodiment, a transfer roller 5 is used as a transfer device. The transfer roller 5 is pressed against the photosensitive drum 1 with predetermined pressing force, and the press-contacting nip portion is a transferring portion D. A transfer material (member to be transferred, recording material) P which is an image receiving member is fed to the transferring portion D from a paper feed mechanism portion (not shown) with predetermined control timing.

The transfer material P fed to the transferring portion d is sandwiched between the rotating photosensitive drum 1 and the rotating transfer roller 5, and is transported. While the transfer material P is sandwiched, a power supply S3 applies to the transfer roller 5 positive transfer bias which is in the opposite polarity to the normal polarity of toner. In this embodiment, application by the power supply S3 of the voltage of +2 kV to the transfer roller 5 causes the toner image on the photosensitive drum 1 to be gradually and electrostatically transferred onto the transfer material P at the transferring portion D.

The transfer material P with the toner image transferred thereon at the transferring portion D is gradually separated from the surface of the photosensitive drum 1, and is transported to a fixing device 6 (heat roller fixing device, for example). The fixing device 6 fixes the toner image transferred onto the transfer material 2, and outputs it as an image forming object (print or copy).

(2) Cleaner-less System and Toner Charge Amount Control

The printer of this embodiment is of a cleanerless type. The printer is not provided with a dedicated cleaning device for removing a small amount of toner remaining on the surface of the photosensitive drum 1 after the toner image is transferred to the transfer material P, that is, so-called residual toner. As the photosensitive drum 1 continues to rotate, residual toner is transported to the developing portion C through the charging portion A and the exposing portion B. The developing device 4 performs cleaning (collecting) simultaneously with developing regarding the residual toner (cleaner-less system). More specifically, an electric field is formed where toner on the developing sleeve 4*b* attaches to the exposing portion of the photosensitive drum 1, and at the same time, an electric field is formed in a direction so as to collect toner from a portion which is not exposed of the photosensitive drum 1 to the developing sleeve 4*b*.

Since residual toner on the photosensitive drum 1 goes through the exposing portion B, the photosensitive drum 1 is exposed through residual toner. However, this does not have much effect, since the amount of the residual toner is small.

However, as described in the above, residual toner includes toner charged in the normal polarity, toner charged in the opposite polarity to the normal polarity (reversal toner), and toner with a small charge amount. When, among residual toner, reversal toner or toner with a small charge amount passes through the charging portion A, the toner attaches to the charging roller 2 to contaminate the charging roller 2 to above an acceptable level, and the charging roller 2 can not sufficiently charge the photosensitive drum 1.

Further, in order for the developing device 4 to effectively develop and simultaneously clean up residual toner, it is necessary that residual toner transported to the developing portion C is charged in the normal polarity and the charge amount is large enough to develop the electrostatic latent image on the photosensitive drum 1 with the developing device 4. Reversal toner and toner with an inappropriate charge amount can not be removed and collected from the surface of the photosensitive drum to the developing device 4, which is a cause of a poor image.

Further, since user needs have been diversified recently, continuous print operation of an image having a high print rate such as a photographic image generates at one time a large amount of residual toner on the photosensitive drum 1, which increases formation of a poor image.

Accordingly, in this embodiment, in order to make uniform the residual toner on the photosensitive drum 1 and to make all the residual toner after transfer charged in the negative polarity which is the normal polarity, a first toner charge amount controlling device (first developer charging member) 7 and a second toner charge amount controlling device (second developer charging member) 8 are provided on a downstream side of the transferring portion D in a photosensitive member rotational direction and on an upstream side of the charging portion A.

In this embodiment, each of the first toner charge amount controlling device 7 and the second toner charge amount controlling device 8 is provided with a brush-like member having appropriate conductivity. Voltage is applied to each of the brush-like members by a power supply, and the brush-like members are arranged such that their brush portions are in contact with the surface of the photosensitive drum 1.

Voltage in the positive polarity is applied to the first toner charge amount controlling device 7 by a power source S4 (+400 V).

Voltage in the negative polarity is applied to the second toner charge amount controlling device B by a power source S5 (−800 V).

A region where the first toner charge amount controlling device 7 is in contact with the surface of the photosensitive drum 1 is a contacting portion E. Among residual toner of various polarities, toner which is not charged or which is charged in the negative polarity is for a time adsorbed by the first toner charge amount controlling device 7.

However, since the amount of toner which can be held by the first toner charge amount controlling device 7 is limited, after saturation is reached, toner gradually leaves and is attached to and transported by the surface of the photosensitive drum 1. Here, the toner which leaves is positively charged, and the distribution of the toner charge amount is made uniform. In this way, the first toner charge amount controlling device 7 charges toner in the positive polarity which is opposite to the normal polarity, and at the same time, makes even the distribution of the toner charge amount.

A region where the second toner charge amount controlling device 8 is in contact with the surface of the photosensitive drum 1 is a contacting portion F. Residual toner on the photosensitive drum 1 which passes through the second toner charge amount controlling device 8 is charged in the negative polarity which is the normal polarity.

Since all the residual toner has already been charged in the positive polarity by the first toner charge amount controlling device 7, the potential difference between the positively charged residual toner and the second toner charge amount controlling device 8 to which voltage in the negative polarity is applied is large, and thus, more effective charge in the negative polarity is performed by discharge.

By charging the toner after transfer in the negative polarity which is the normal polarity of the toner by the second toner charge amount controlling device 8, when the surface of the photosensitive drum 1 is charged through the negatively charged residual toner in the downstream charging portion A, reflection power of the residual toner to the photosensitive drum 1 becomes larger. Therefore, the residual toner can be prevented from attaching onto the charging roller 2. Further, since the residual toner is charged in the normal polarity, the developing sleeve 4*b* can efficiently collect the residual toner.

It is to be noted that, although, in this embodiment, a structure including the plurality of toner charge amount controlling devices 7 and 8 is described, the structure may have only a single toner charge amount controlling device if the single toner charge amount controlling device can uniformly charge the residual toner in the normal polarity.

Next, collection of the residual toner in the developing process is now described.

As described above, the developing device 4 collects the residual toner from the photosensitive drum 1 simultaneously with the development. In order to make the residual toner on the photosensitive drum 1 collected by the developing device 4, it is necessary that the toner charge amount is appropriate.

However, in order to prevent toner from attaching to the charging roller 2, residual toner excessively charged in the negative polarity by the second toner charge amount controlling device 8 is, by eliminating the charge, more efficiently collected in the developing device 4.

Here, in order to charge the peripheral surface of the photosensitive drum 1, voltage formed by superinposing direct voltage on alternating voltage is applied to the charging roller 2. Residual toner is eliminated by the action of the alternating voltage (frequency f; 1000 Hz and Vpp: 1400V) applied to the charging roller 2. More specifically, the absolute value of the charge amount of residual toner is decreased by the charging roller 2. Therefore, in the developing process, residual toner on the photosensitive drum 1 which should not be developed is collected by the developing device 4 for the above reason.

There has been described above an operational mechanism of a cleaner-less image forming apparatus in a steady state.

However, toner trapped to some extent by physical power or the like in the first and second toner charge amount controlling devices may be expelled onto the photosensitive drum 1 upon start-up of the image forming apparatus. Especially when the voltage applied to the first and second toner charge amount controlling devices 7 and 8 is on a steep rise, it is more likely that toner is expelled onto the photosensitive drum 1. Since the charge amount of toner expelled onto the photosensitive drum 1 is not controlled, the toner attaches to the charging roller and causes contamination at the transferring portion, to thereby result in a poor image.

Next, a relationship between a method of applying bias from the power supply S4 to the first toner charge amount controlling device and expelled toner from the toner charge amount controlling device is described.

Figure 3:
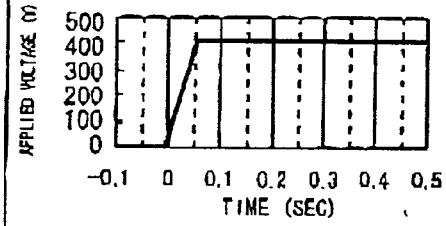
FIG. 3 is a table illustrating measurement results with regard to the relationship between the slope of bias applied to a first toner charge amount controlling device and whether toner is expelled or not.
Figure 3:
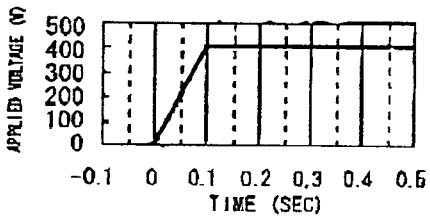
Figure 3:
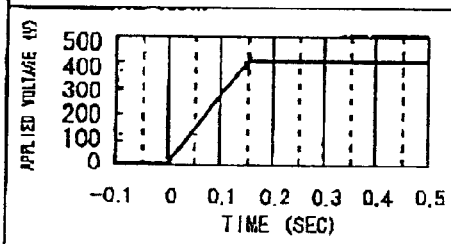
Figure 3:
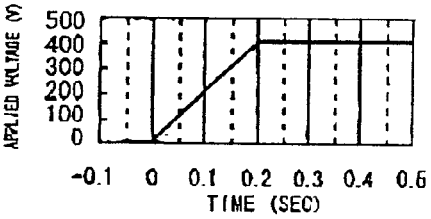
Figure 3:
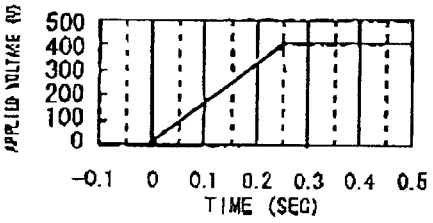

FIG. 3 is a table illustrating measurement results of time period until the bias applied to the first toner charge amount controlling device 7 is in a steady state, the slope of the bias, and whether toner is expelled or not from the first toner charge amount controlling device 7.

The bias applied to the first toner charge amount controlling device 7 is +400 V. From the results shown in FIG. 3, it is found that, when the time period from the point where the bias begins to be applied to the point where the predetermined bias, +400 V, is applied to the first toner charge amount controlling device 7 is 0.2 seconds or longer, toner is not expelled from the first toner charge amount controlling device 7. The slope of the applied bias at this point is 2000 V/sec.

Next, a similar experiment is performed with regard to the second toner charge amount controlling device 8.

Figure 4:
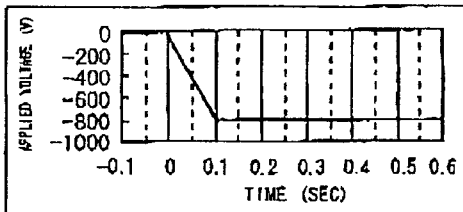
FIG. 4 is a table illustrating measurement results with regard to the relationship between the slope of bias applied to a second toner charge amount controlling device and whether toner is expelled or not.
Figure 4:
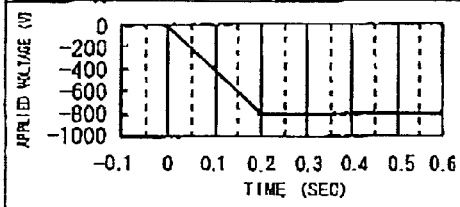
Figure 4:
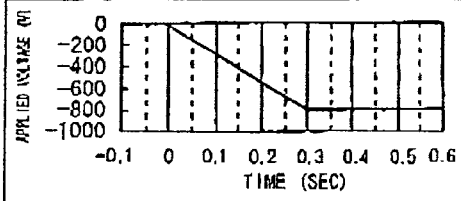
Figure 4:
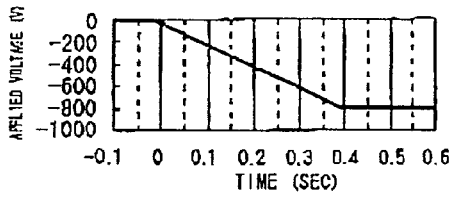
Figure 4:
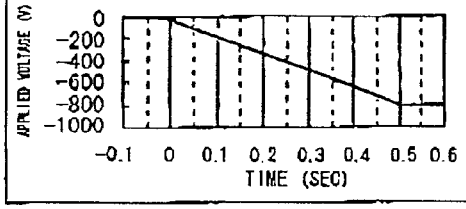

FIG. 4 is a table illustrating measurement results of time period until the bias applied to the second toner charge amount controlling device 8 is in a steady state, the slope of the bias, and whether toner is expelled or not from the second toner charge amount controlling device 8.

The bias applied to the second toner charge amount controlling device 8 is −800 V. From the results shown in FIG. 4, it is found that, when the time period from the point where the bias begins to be applied to the point where the predetermined bias, −800 V, is applied to the second toner charge amount controlling device 8 is 0.4 seconds or longer, toner is not expelled from the second toner charge amount controlling device 8. The slope of the applied bias at this point is −2000 V/sec.

From the above results, it is found that, when the absolute value of the slope of the applied bias is 2000 V/sec or smaller, toner expelled from the toner charge amount controlling devices is suppressed.

Figure 5:
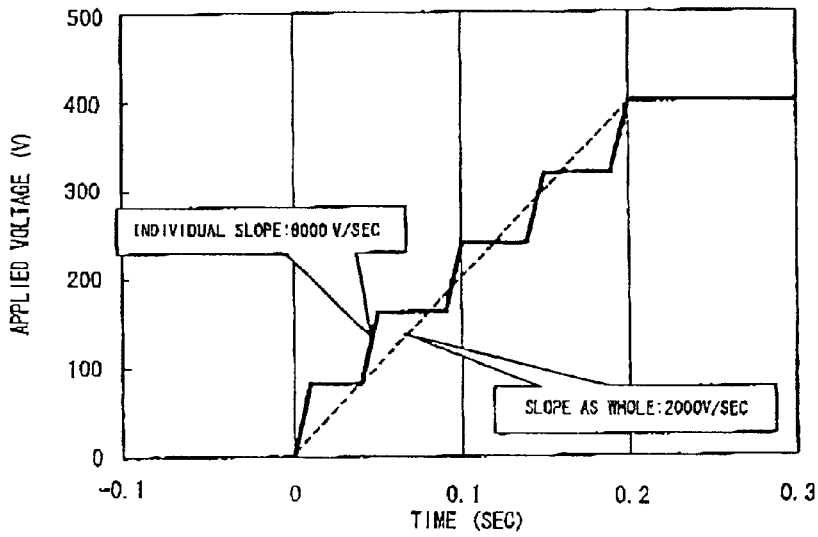
FIG. 5 is a relational view illustrating difference between a whole application slope and an individual application slope.

On the other hand, as illustrated in FIG. 5, it is found that, even though the slope of the applied bias as a whole is 2000 V/sec, if an individual slope of the applied bias is 8000 V/sec, toner is expelled.

It is preferable that the first toner charge amount controlling device 7 applies the DC bias to the photosensitive drum 1 after a region of the surface of the photosensitive drum 1 which has been charged by the charging roller 2 reaches the contacting portion E.

Further, similarly, it is preferable that the second toner charge amount controlling device 8 applies the DC bias to the photosensitive drum 1 after the region of the surface of the photosensitive drum 1 which has been charged by the charging roller 2 reaches the contacting portion F.

If the slope of the applied bias is too gentle, the start-up time period (time for prior preparatory rotation of the photosensitive drum 1) becomes long, and the potential of the photosensitive drum 1 may be changed. Therefore, it is preferable that the start-up time period for applying bias is equal to or shorter than the time necessary for the photosensitive drum 1 to make a rotation. More specifically, time period from the point where the DC bias is applied to the toner charge amount controlling devices to the point where the applied bias reaches the steady value preferably does not exceed the time necessary for the photosensitive drum 1 to make a rotation.

As described above, when DC bias is applied to a developer charging member, control is made such that the absolute value of the slope of the applied DC bias is 2000 V/sec or smaller. As a result, the bias can be applied without discharging developer being trapped in a developer charge amount controlling device, and occurrence of a poor image can be suppressed.

What is claimed is:

1. An image forming apparatus comprising:

an image bearing member;

a charging device for charging said image bearing member;

a developing device for developing with developer an electrostatic image formed on said image bearing member to form a developer image;

a transfer device for transferring said developer image from said image bearing member onto an image receiving member; and a developer charging member for charging residual developer on said image bearing member, said developer charging member being in contact with said image bearing member and provided on a downstream side of said transfer device and on an upstream side of said charging device in a moving direction of said image bearing member, wherein a DC voltage is applied to said developer charging member and an absolute value of a slope of the DC voltage when an application of the DC voltage is started is 2000 V/sec or smaller.

2. An image forming apparatus as claimed in claim 1, wherein said developer charging member makes uniform a charge amount of the residual developer.

3. An image forming apparatus as claimed in claim 1, wherein a start-up time period when the application of the DC voltage is started is equal to or shorter than a time necessary for said image bearing member to make a rotation.

4. An image forming apparatus as claimed in claim 1, wherein said charging device includes a contact charging member capable of being in contact with said image bearing member.

5. An image forming apparatus as claimed in claim 4, wherein voltage formed by superimposing an AC voltage on a DC voltage is applied to said contact charging member.

6. An image forming apparatus as claimed in claim 5, wherein a charge amount of the residual developer is decreased by said contact charging member.

7. An image forming apparatus as claimed in claim 1, wherein said developer charging member includes a conductive brush in contact with said image bearing member.

8. An image forming apparatus as claimed in claim 1, wherein said developer charging member charges the residual developer in a normal charging polarity of the developer.

9. An image forming apparatus as claimed in claim 8, further comprising:

a second developer charging member for charging the residual developer, said developer charging member being in contact with said image bearing member and provided on a downstream side of said transfer device and on an upstream side of said developer charging member in the moving direction of said image bearing member, wherein a DC voltage having a polarity opposite to the normal charging polarity of the developer is applied to said second developer charging member.

10. An image forming apparatus as claimed in any one of claims 1 to 9, wherein said developing device is capable of performing a collecting operation for collecting the residual developer from said image bearing member simultaneously with a developing operation.

11. An image forming apparatus as claimed in claim 10, wherein said charging device charges in a same polarity as the normal charging polarity of said developer.

12. An image forming apparatus comprising:

an image bearing member;

a charging device for charging said image bearing member;

a developing device for developing with developer an electrostatic image formed on said image bearing member to form a developer image;

a transfer device for transferring said developer image from said image bearing member onto an image receiving member;

first developer charging member for charging residual developer on said image bearing member, said first developer charging member being in contact with said image bearing member and provided on a downstream side of said transfer device and on an upstream side of said charging device in a moving direction of said image bearing member, and a DC voltage having a polarity opposite to a normal charging polarity of the developer being applied to said first developer charging member; and a second developer charging member for charging the residual developer in the normal charging polarity of the developer, said second developer charging member being in contact with said image bearing member and provided on a downstream side of said first developer charging member and on an upstream side of said charging device in the moving direction of said image bearing member, and a DC voltage having the normal charging polarity of the developer being applied to said second developer charging member, wherein an absolute value of a slope of the DC voltage applied to said first developer charging member when the application of the DC voltage to said first developer charging member is started and an absolute value of a slope of the DC voltage applied to said second developer charging member when the application of the DC voltage to said second developer charging member is started are equal to 2000 V/sec or smaller.

13. An image forming apparatus as claimed in claim 12, wherein said first developer charging member makes uniform a charge amount of the residual developer.

14. An image forming apparatus as claimed in claim 12, wherein said first developer charging member charges the residual developer in the polarity opposite to the normal charging polarity of the developer.

15. An image forming apparatus as claimed in claim 12, wherein a start-up time period when the application of the DC voltage applied to said first developer charging member and the DC voltage applied to said second developer charging member is started equals or is shorter than a time necessary for said image bearing member to make a rotation.

16. An image forming apparatus as claimed in claim 12, wherein said charging device includes a contact charging member capable of being in contact with said image bearing member.

17. An image forming apparatus as claimed in claim 16, wherein a voltage formed by superimposing an AC voltage on a DC voltage is applied to said contact charging member.

18. An image forming apparatus as claimed in claim 17, wherein a charge amount of the residual developer is decreased by said contact charging member.

19. An image forming apparatus as claimed in claim 12, wherein each of said first and second developer charging members include a conductive brush in contact with said image bearing member.

20. An image forming apparatus as claimed in any one of claims 12 to 19, wherein said developing device is capable of performing a collecting operation for collecting the residual developer from said image bearing member simultaneously with a developing operation.

21. An image forming apparatus as claimed in claim 20, wherein said charging device charges in a same polarity as the normal charging polarity of the developer.

* * * * *

UNITED STATES PATENT AND TRADEMARK OFFICE

CERTIFICATE OF CORRECTION

PATENT NO. : 6,611,668 B2
DATED : August 26, 2003
INVENTOR(S) : Yasunari Watanabe et al.

It is certified that error appears in the above-identified patent and that said Letters Patent is hereby corrected as shown below:

Title page,
Item [56], FOREIGN PATENT DOCUMENTS, "08234545 A" should read -- 8-234545 A --.

Signed and Sealed this

Ninth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,611,668 B2
DATED : August 26, 2003
INVENTOR(S) : Yasunari Watanabe et al.

It is certified that error appears in the above-identified patent and that said Letters Patent is hereby corrected as shown below:

Title page,
Insert the following:

-- [30] Foreign Application Priority Data

Sept. 4, 2001 (JP) 2001-267870 --.

Signed and Sealed this

Eleventh Day of May, 2004

JON W. DUDAS
*Acting Director of the United States Patent and Trademark Office*